United States Patent [19]

Reed

[11] Patent Number: 4,744,426

[45] Date of Patent: May 17, 1988

[54] APPARATUS FOR REDUCING HYDRO-STATIC PRESSURE AT THE DRILL BIT

[76] Inventor: John A. Reed, 204 H Long Plantation Rd., Lafayette, La. 70508

[21] Appl. No.: 869,314

[22] Filed: Jun. 2, 1986

[51] Int. Cl.[4] ..... E21B 4/02; E21B 21/00

[52] U.S. Cl. ..... 175/102; 175/106; 175/107; 175/323; 175/324

[58] Field of Search ..... 175/324, 323, 92, 107, 175/100-102, 317, 339, 106

[56] References Cited

U.S. PATENT DOCUMENTS

| | | | |
|---|---|---|---|
| 2,794,617 | 6/1957 | Yancey | 175/323 |
| 3,656,565 | 4/1972 | Fox | 175/323 |
| 4,049,066 | 9/1977 | Richey | 175/323 |
| 4,137,975 | 2/1979 | Pennock | 175/65 |

FOREIGN PATENT DOCUMENTS

| | | | |
|---|---|---|---|
| 791884 | 12/1980 | U.S.S.R. | 175/100 |

*Primary Examiner*—James A. Leppink
*Assistant Examiner*—Hoang C. Dang
*Attorney, Agent, or Firm*—Pravel, Gambrell, Hewitt, Kimball & Krieger

[57] ABSTRACT

A downhole tool positioned intermediate the mud motor and the drill bit, for reducing the hydro-static head near or around the bit. What is provided is an upper body portion threadably attachable to the mud motor and having an internal shaft with a bore therethrough for allowing mud to flow down the shaft rotatable during the the operation of the tool. The upper body portion further includes a gear member on the outer wall of the shaft for rotatably engaging the pair of upper gear members which imparts rotation to a pair of lower gear members for further imparting rotation to a fan member located in the lower portion of the tool. The lower portion of the tool member is flared to substantially engage the inner wall of the bore, with the interior of the lower flared portion housing the multi-vane fan so that upon rotation of the fan, the mud below the fan member is sucked into the fan through ports in the bottom of the tool, and out of lateral ports in the wall of the lower section, this movement of mud is effectively being "pulled" off of the bit to decrease the weight of the column of mud at the bit for more effective cutting. A second embodiment would include in the gearing section of the tool a bell gear member for imparting increased rotation to the fan member for more effective lowering of the weight of the mud at the bit.

10 Claims, 2 Drawing Sheets

APPARATUS FOR REDUCING HYDRO-STATIC PRESSURE AT THE DRILL BIT

BACKGROUND OF THE INVENTION

1. Field of the Invention

The present invention relates to drilling of oil and gas wells. More particularly, the present invention relates to an apparatus positioned above the drill bit for reducing the hydro-static pressure of the column of mud at the bit for producing a more effective drilling by the bit into the rock formation.

2. General Background

In the drilling process of an oil or gas well, as the drill bit cuts through the formation which is often times rock or other hard substances, drilling muds of various weights are normally pumped through the bore in the drill string, through a number of drill collars, which serve to put additional weight onto the bit as it cuts through the formation, and through the drill bit to both lubricate the bore as the drill bit is drilling therethrough, hold back the formation, and to return up the annulus between the drill string and the wall of the bore to remove the cutting or the like which are cut from the rock formation. As the bore is increased in depth, the mud which must be pumped down the bore becomes quite heavy; that is, weighing literally hundreds of thousands of pounds and the back pressure of the mud to the bore increases because of the weight of the column. As this back pressure of the mud increases, or "hydro-static pressure" increases, it requires a higher pressure in the drill string in order to overcome the hydro-static head of the column of mud standing in the annulus. Therefore, this high back pressure in the annulus produces a force which is detremental to the jetting action of the mud flow, and in turn slows the effectivness of the cutting action of the bit. Therefore, this is undesirable in that the washing away of the cuttings near the vicinity of the bit is reduced, and therefore the effectivness of the bit is likewise reduced.

Therefore, it would be desirable to somehow reduce the weight column of mud near the drill bit during the drilling process, so that the drill bit is able to cut more effectively into the formation due to the decrease in pressure on the formation. This reduction of pressure or weight on the formation would drastically increase the effectiveness of the bit during the dirlling process.

There have been several patents addressing this particular activity, the most pertinent being as follows:

U.S. Pat. No. 4,049,066 issued to V. T. Richey and entitled "Apparatus For Reducing Annular Back Pressure Near The Drill Bit", discloses a device which is placed in the drill string immediately above a drill bit and below the drill collars. It incorporates an elongated tube which is threaded into the drill string and there is located an interior shaft having several sets of blades for rotating in response to the mud flow around the shaft. A rotatable exterior sleeve is mounted within a multi-turn helical screw. The mud is picked up by the bottom most flight of the helical thread on the exterior rotatable sleeve and is pulled rapidly away from the bottom of the well thus attempting to reduce the pressure just above the drill bit.

U.S. Pat. No. 4,312,415, issued to R. L. Franks, Jr. and entitled "Reverse Circulating Tool", discloses a tool which, although does not contain the fan or helical screw in order to remove mud away from the bit, it does provide for reverse circulating of drilling fluid, and apparently while the drilling fluid is able to escape from below the apparatus, it attempts to relieve the pressure which would enable less weight on the drill bit. The object of this invention is to help relieve the pressure on the bit.

U.S. Pat. No. 4,368,787, issued to J. U. Messenger and entitled "Arrangement For Removing Borehole Cuttings By Reverse Circulation With A Downhole Bit-Powered Pump", does teach the use of a pumping apparatus which is a reversible pump in order to pull the cuttings and such away from the drill bit so that there is no chance of pressure - differential sticking of the drill string.

U.S. Pat. No. 4,436,166, issued to A. Hayatdavoudi et al, and entitled "Downhole Vortex Generator And Method", discloses an apparatus which is designed to create an upward swirling flow in an annulus above the drill bit for removing cuttings and the like. In the summary of the invention the aim of the invention is to divert a portion of the downward flowing drilling fluid from the drill string and inject it into the annulus so that it imparts a swirling vortex motion. Although it does not address the question of reducing the hydro-static pressure on the bit, it does disclose a means for moving the drilling fluid and cuttings away from the bit.

U.S. Pat. No. 4,479,558, issued to E. R. Gill, et al, entitled "Drilling Sub", like the previous patent, also addresses the question of creating a vortex in the annulus for removal of drilling fluid and the like from around the bit.

U.S. Pat. Nos. 2,894,585; 2,234,454; and 2,990,894 likewise are patents which show drill string devices that are designated to create a vortex to draw up the fluid and cuttings from the drill bit.

SUMMARY OF THE PRESENT INVENTION

The apparatus of the present invention solves the problems of the art in a straightforward manner. What is provided is a downhole tool positioned intermediate the mud motor and the drill bit, for reducing the hydrostatic head near or around the bit. What is provided is an upper body portion threadable attachable to the mud motor and having an internal shaft with a bore therethrough for allowing mud to flow down the shaft to the bit, rotatable during the the operation of the tool. The upper body portion further includes a gear member around the outer wall of the shaft for rotatably engaging the pair of upper gear members which imparts rotation to a pair of lower gear members for further imparting rotation to a fan member located in the lower portion of the tool. The lower portion of the wall of the tool member is flared to substantially engage the inner wall of the bore, and to distribute the weight of the tool on bearings more evenly, with the interior of the lower flared portion housing the multi-vane fan so that upon rotation of the fan, the mud below the fan member is "sucked" into the fan through ports in the bottom of the tool, and out of lateral ports in the wall of the lower section; this movement of mud effectively being "pulled" off of the bit to decrease the weight of the column of mud at the bit for more effective cutting. A second embodiment would include in the gearing section of the tool, a bell gear member for imparting increased rotation to the fan member for more effective movement of the mud away from the bit and lowering of the weight of the mud at the bit.

Therefore it is an object of the present invention to provide an apparatus for reducing the hydro-static pressure at the bit which is situated between the mud motor and the bit and operates in conjunction with the mud motor;

It is a further object of the present invention to provide an apparatus for lifting mud away from the bit by pulling the mud up from the bit for reducing the weight mud on the bit;

It is still a further object of the present invention to provide an apparatus for reducing the hydro-static pressure of the bit by incorporating a multi-vane fan member within the body of the apparatus above the bit for rotatable pulling the mud from the bit during the operation of the apparatus;

It is still a further object of the present invention to provide an apparatus for reducing the hydro-static pressure at the bit which is capable of moving a greater quantity of mud away from the bit that is being pumped down into the bit so as to create a "vacuum" or reduced pressure area and thus reducing the weight of the mud column on the bit.

It is still a further object of the present invention to provide an apparatus for creating the drilling weight and eliminating troublesome drill collars.

BRIEF DESCRIPTION OF THE DRAWINGS

FIG. 6-A is a cross-sectional view of an additional set of gears within the apparatus for gearing up in the apparatus of the present invention;

DETAILED DESCRIPTION OF THE PREFERRED EMBODIMENT

Figure 1:
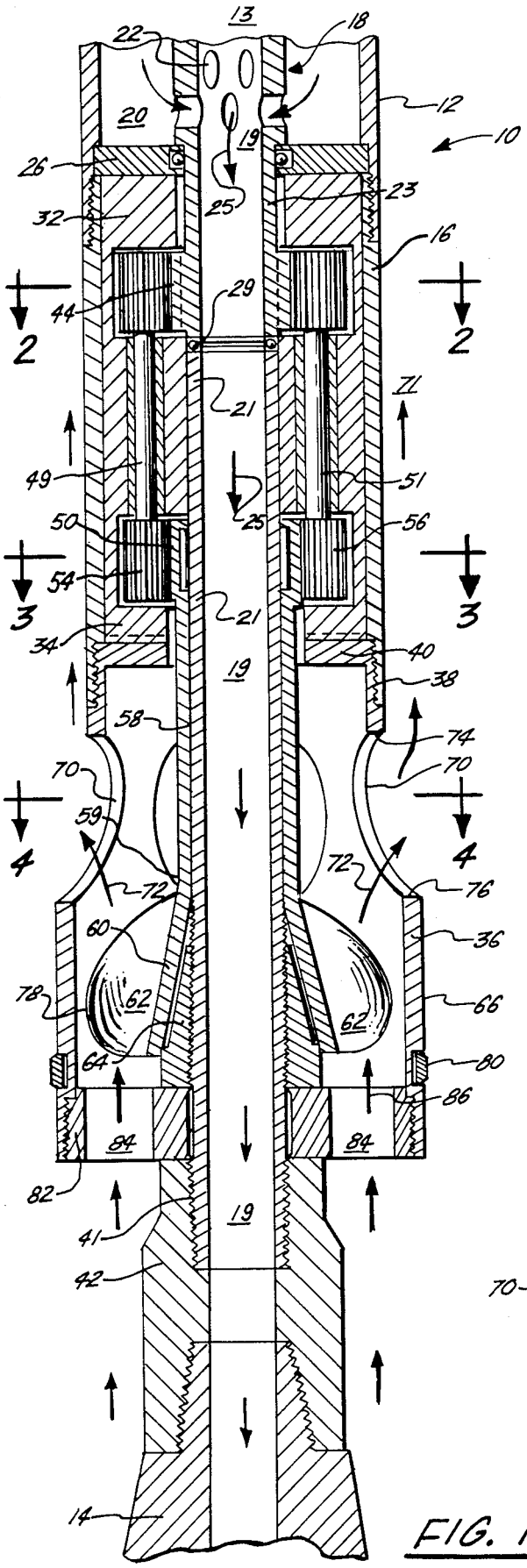
FIG. 1 is an overall cross-sectional view of the preferred embodiment of the apparatus of the present invention.
Figure 2:
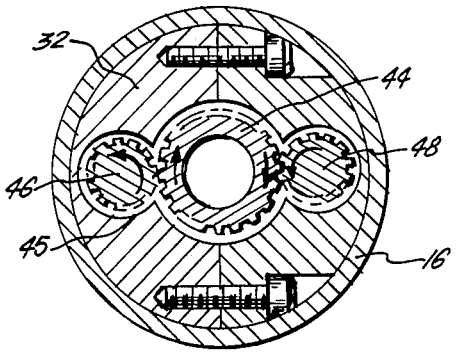
FIG. 2 is a top cross-sectional view along lines 2—2 in FIG. 1 illustrating the upper gearing mechanism of the apparatus of the present invention.

FIGS. 1–4 and FIG. 8 illustrate the preferred embodiment of the apparatus of the present invention as illustrated by the numeral 10. As seen in the FIGURES, particularly in FIG. 1, apparatus 10 includes an outer annular closed housing 12 which is attachable at its upper end 13 (not illustrated), to a standard mud motor which is a standard motor utilized in drilling for pumping mud down into bit 14 as seen in the FIGURE. Housing 12 at its lower portion would threadably engage a second intermediate exterior closed housing 16 to form a continuous annular closed housing in the upper portion of the tool, which will be discussed at this time. Contained within the upper portion of the tool housings 12 and 16 are included an internal shaft 18 having a bore 19 therethrough wherein mud 19 is moved from the mud motors through interior space 20, through ports 22 in shaft 18 down into the internal bore 19 in the direction of arrows 25 to the bit 14 in order to lubricate the bit and to wash the cuttings away from the bit during the cutting process. Shaft member 18 is provided with an upper rotating shaft member 23 which is powered by the mud motor, and a lower portion of the shaft member 21 which is threadably engaged to connector 42 at point 41 rotating with the drill string. The upper shaft portion 23 and lower shaft portion 21 are rotatably mounted at bearings 27. Upper portion 23 of shaft member 18, rotating during the drilling process, is supported by internal annular shoulder plate 26 which is supportingly engaged at the juncture of annular wall 12 and 16 and supports shaft 18 at shoulder portion 28 and allows rotation of shaft 18 with bearing members 30. Directly below shoulder plate 26 there is provided an interior housing means 32 which, as seen in the top view in FIG. 2 is a solid metal housing which fills the entire inner space of annular housing 16 providing only space for the gearing mechanisms as will be discussed further. Solid internal housing 32 adds further support to shoulder plate 26 in supporting shaft 18, and itself is supported on its lower face 34 at the juncture of housing 16 and the lower housing 36 of the tool as that lower house threadably engages housing 16 at point 38 having an upper face member 40 for supporting the internal housing 32 thereupon. Face member 40 and housing 32 are rotatably engaged for preventing housing 32 from rotating within outer housing 16.

Therefore, in general the entire tool 10 is comprised of basic exterior housings 12, 16 and lower housing 36 to make up the total exterior housing of the tool.

Turning now to the internal gearing mechanism within intermediate housing 16 and solid housing 32, reference is made to shaft 18, as it is directed down through the tool and threadably engages a lower connector joint 42, located between the tool 10 and the bit 14. Shaft 18 at its upper portion further includes an exterior gear member 44 around its exterior wall as seen in the top view in FIGS. 2 and 3, with the teeth 45 of the gear member 44 meshing with the teeth of auxiliary gear members 46 and 48 as the shaft is rotated during the operation of the mud motor. Therefore, as shaft 18 is rotated the rotation of shaft 18 and gear 44 in the clockwise direction imparts rotation of auxiliary gears 46 and 48 in the counter-clockwise direction. The reason for that to be discussed further.

As further seen in FIG. 1, gears 46 and 48 include a lower elongated body portion 49 and 51 respectively, which are likewise housed within internal housing 32 and interconnect to a lower pair of gears 54 and 56 so that rotation of gears 46 and 48 by gear 44 likewise imparts rotation to gears 54 and 56. This gearing to the outside from the internal gear 44 to gears 54 and 56 is crucial in the overall operation of the tool. Two gear members in this portion of the tool is preferably to both balance the rotation of the internal rotation of the tool and to add additional strength to the tool.

Figure 3:
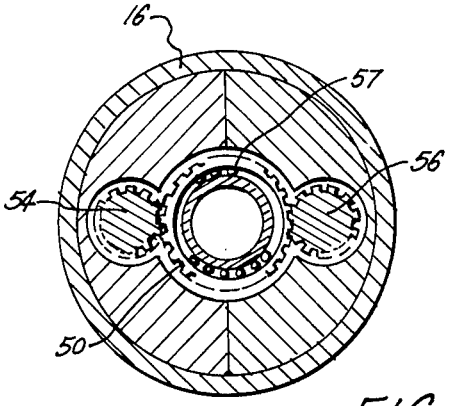
FIG. 3 is a cross-sectional view along lines 3—3 of FIG. 1 illustrating the lower gearing mechanism of the apparatus of the present invention.
Figure 4:
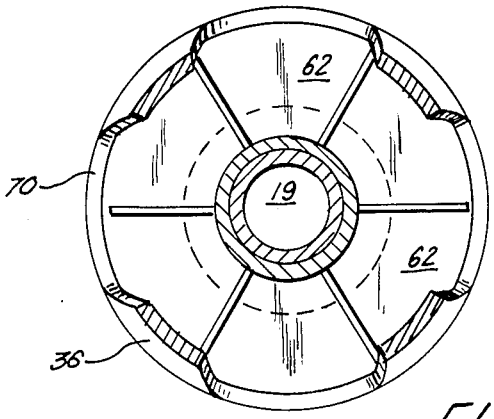
FIG. 4 is a cross-sectional view of along lines 4—4 of FIG. 1 illustrating the fan mechanism of the apparatus of the present invention.

This is so because the lower portion 35 of the tool includes the means for moving the mud away from the bit. This is accomplished through the following manner. Along lower shaft portion 21 of shaft 18 within the lower housing 36 of the tool there is included an exterior fan shaft 58 which has in its upper end an internal gear member 50, which is illustrated in FIG. 3 top view, which meshes with gears 54 and 56, so that the rotation of gears 54 and 56 likewise impart rotation to fan shaft 58. Fan shaft 58 is coaxially aligned around lower shaft 21 and rotates on bearings 57 as seen in FIG. 3. Further, fan shaft 58 follows along the internal shaft 21 and fans outwardly at point 59 to a frustro-conical body portion 60 wherein fan blades 62 are set thereupon. It should be noted that body portion 60 as it flares away from shaft 18 is supported by an annular wedge member 64 having a plurality of bearings 66 located intermediate the wedge member 64 and the body of fan shaft 60 to provide ease of rotation of the fan during the operation of the tool.

Further, the lower body portion 36 of the apparatus directly below the juncture of the housing 16 and body 36 at threads 38, includes a plurality of enlarged flow ports 70 which allow flow of mud through the apparatus and out through the flows port 70 as seen by arrow 72. Likewise, body portion 36, as is seen particularly in FIG. 1, shows a flaring of the body portion from that portion of body portion 36 at the top point 74 of ports 70 and the lower point 76 of ports 70. This flaring is necessary in order to accommodate the width of the fan blades 62 within housing 36 since the width of fan blades 62 provide a confined space 78, which may be as small as a few thousandths of an inch, between the outer most face of fan blade 62 and the inner wall of housing 36. Further, housing 36 is of the particular exterior diameter to be basically positioned within the width of the bore so that no mud flowing upward from the bit can bypass between the tool and the borehole. This is accommodated with a flexible and annular ring member 80 which is housed within the exterior body portion 36 and extrudes therefrom so as to make contact with the wall of the bore as the tool is in position and is capable of flexing to adapt to out of guage hole. The lower most face of the tool includes a lower plate 82 which is threadably engaged to the lower portion of housing 36, lower plate 82 having a plurality of ports 84 to which the mud from the bit flowing upward in the direction of arrows 86 flows through the ports to flow into the tool.

Figure 8:
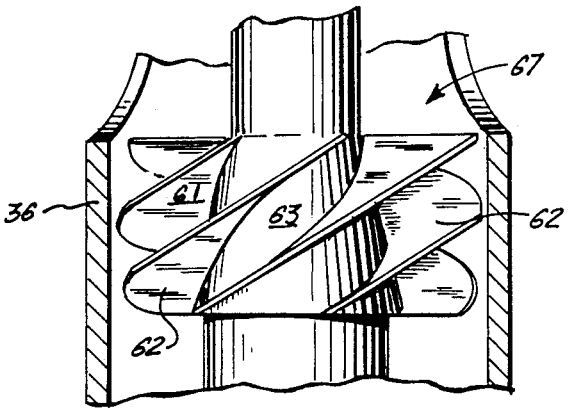
FIG. 8 is a side view of the fan mechanism in the preferred embodiment and in the additional embodiment of the apparatus of the present invention.

In the operation of the tool it is crucial to fully appreciate the positioning of fan blades 62 within body portion 36. As seen in FIG. 8, fan blades 62 include a plurality of helically situated blades forming a space 63 there between through which mud travels upward. This spacing between the plurality of blades 62 is crucial to effectively draw the mud through the blades and be expelled upward out ports 70 and to therefore have the tool work in an effective manner. In the operation of the tool, upon the tool being placed in position and the drilling begins with rotation of the drill string imparting rotation to the bit 14, mud likewise is pumped from the mud motor down interior port 19 into the bit. When the mud motor is in operation, upper shaft portion of shaft 18 is rotated at a high rate which likewise imparts rotation to gears 46 and 48, lower gears 54 and 56, which likewise would impart further rotation to fan shaft 58 and fan blades 62 of fan means 67. As the mud and cuttings are returned from the bit in the direction of arrow 86 through ports 84, fan blades 62 create a reduced pressure which draws the mud upward through the blades and out through ports 70 to be directed along the annular space 71 between the wall of the bore and wall 16 and wall 12 of the tool up to the floor of the rig to be returned again. It is this drawings of the mud by the fan means which would enable the weight of the mud to be reduced at the bit in a more effective cutting occurs.

It is important to note that the fan must have the ability to pump a greater quantity of mud that is being pumped down the tool by the rig pumps by gearing up the fan. A hypothetical example would be for example if the rig pumps are pumping 350 gallons per minute down to the center shaft through bit 14 of annulus 86, this much pumping ability is provided by the rig pumps for the 350 gallons. The horse power from the mud motor is geared out of the fan and geared up to provide a boost to pump 450 gallons per minute by the fan in the tool. Therefore, in effect, the rig is pumping the first 350 gallons per minute and the fan would increase that pumping rate 100 gallons or to 450 gallons per minute. Since it is impossible to pump 450 gallons per minute when there are only 350 gallons of mud available to pump, the fan would therefore in effect have geared up as such as it will create this lifting effect of the mud column away from the bit. Thus the hydro-static head at the bit is reduced providing the drilling weight and increasing the drill rate through lower hydro-static head of the bit.

Figure 5:
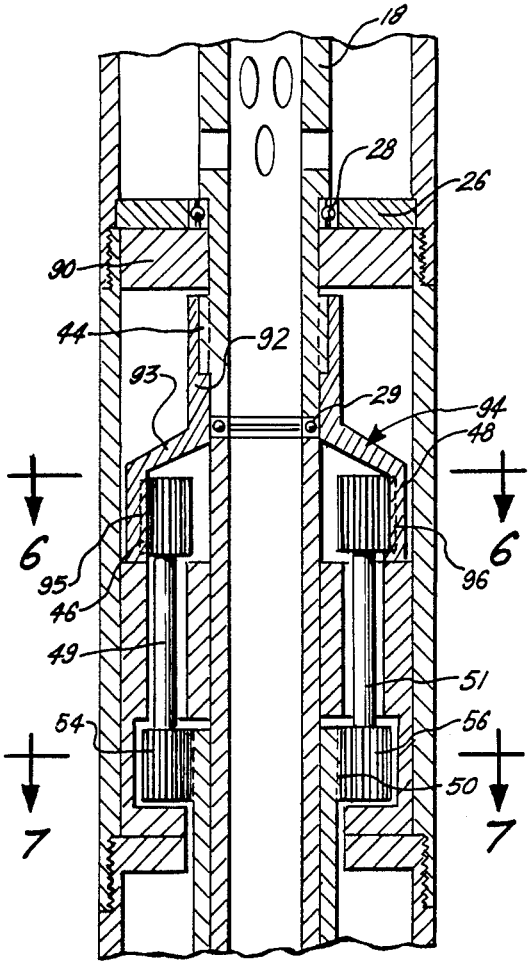
FIG. 5 is a partial cross-sectional view of an additional embodiment of the apparatus of the present invention.
Figure 6:
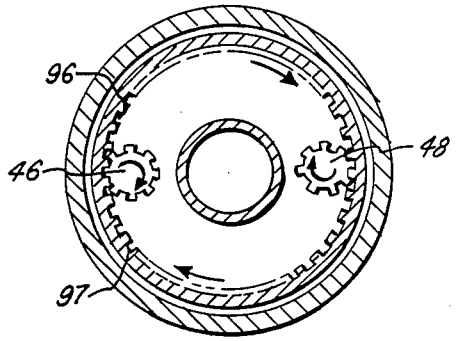
FIG. 6 is a cross-sectional view along lines 6—6 in FIG. 5 of the upper gearing mechanism of the apparatus of the present invention.
Figure 7:
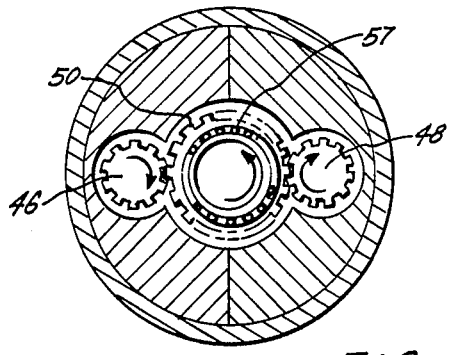
FIG. 7 is a cross-sectional view along lines 7—7 in FIG. 5 of the lower gearing mechanism of the apparatus of the present invention.

Reference is now made to the additional embodiment of apparatus 10, as seen in FIGS. 5–7. Basically, the overall operation of the fan blade and the rotation of shaft member 18 is identical in nature. The differences in the structure would include that section of the tool which incorporates the internal gearing mechanisms of the tool. As seen in FIG. 5, as with the previous embodiment, there is also included a shoulder plate 26 which supports shaft 18 and a plurality of bearings 28 which allow rotation of shaft 18 vis-a-via plate member 26. Directly below plate member 26 there is situated a support block 90 in this additional embodiment, which likewise adds support to shaft 18 during operation of the tool.

It is this portion of the apparatus wherein the additional embodiment modifications are included. As seen in FIG. 5, shaft 18 further includes internal gear 44 on its wall portion. However, rather than meshing with gears 46 and 48 as with the principal embodiment, gear 44 meshing with the upper throat portion 92 of a bell gear 94. As seen in the FIGURE, bell gear 94 includes a flared shoulder portion 93 leading down to a bell portion 95 which includes a gear 96 on its interior wall so that rotation of gear 44 imparts rotation to bell gear 94.

It is at this juncture that the gear system which was included into the principal embodiment is differentiated. The gear system would further include upper gears 46 and 48 having lower body portions 49 and 51 respectively and a pair of lower gear members 54 and 56 as with the principal embodiment. However, gear members 46 and 48 would mesh with teeth 97 of bell gear 96 for imparting rotation to gear members 46 and 48 gearing up to a greater speed. Likewise, this rotation would impart rotation to gear members 54 and 56, with gear members 54 and 56 meshing with the gear 50 on fan housing 58 as with the principal embodiment, for imparting rotation to fan means 67.

In this additional embodiment, the utilization of the bell gear for gearing out to the exterior wall of the apparatus as opposed to the internal gear member 44 in the preferred embodiment, accomplishes two basic results. The most pertinent result is that the rotation of expanded bell gears 94 imparts a "gearing up", of gear members 46 and 48 to be rotated at a much higher speed than in the preferred embodiment. This may be necessary in the ultimate configuration of the tool. Likewise, whereas in the principal embodiment as the mud motor is rotated clockwise the gear members 46 and 48 are rotated in the counter-clockwise direction which likewise imparts counter-clockwise rotation to the lower gear members 54 and 56 identical or clockwise direction of rotation to fan 61. However, in the utilization of the bell gear, as seen in FIGS. 5–7, as the shaft member 18 is rotated in the clockwise direction, the bell gear is likewise rotated in the clockwise direction with gear members 46 and 48 being rotated likewise in the clockwise direction and fan member 61 being rotated in the counter-clockwise direction. If this occurs, then vanes 62 on fan means 67 must be directed in the opposite direction as seen in FIG. 8 i.e., the slope of the blades 62 must be from up to down going left to right so that since the fan is being rotated in the counter-clock wise direction mud must still be pulled away from the bit.

Figure 6A:
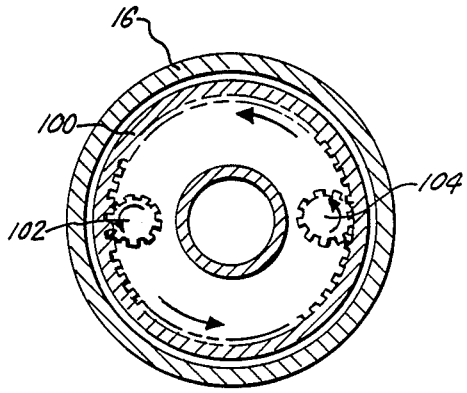

Therefore, in order to assure that the fan motor is rotating in the proper direction, and to further increase the speed of the fan blade, it may be necessary that below first bell gear 94 at the position of gear members 54 and 56 rather than gears members 54 and 56 meshing with the gear in fan housing 58, that a second bell housing, for example 100 as seen in FIG. 6A, be incorporated into the apparatus, and a second series of lower gear members 102 and 104 be incorporated in order to turn the rotation of the fan members 61 in the proper direction. This type of rotation and inclusion of a second bell gear is yet to be experimented upon, but is forseen as a possibility in the ultimate configuration of the operation of the tool.

For purposes of clarification as to the effectivness of such a tool, reference should be had to the following set of equations which will basically outline the weight differential when the weight of the mud pulled away from the drill bit reducing the hydro-static pressure at the bit, equivalent to a 10 pound mud at the unit and 11 pound mud above the fan. This formula is as follows:

| The formula for measuring Hydro-Static pressure (PSI): |
|---|
| HP = Depth (TVD feet) × mud weight × .052 |
| Wherein TVD = True vertical depth |
| .052 = standard coeficient |
| mudweight = pounds per gallon |
| Wherein the area of a circle is: |
| A = ¶ r2 |
| Example: The hydro-static pressure at 11000 feet with 11 pound mud |
| HP1 = 11000 × 11 × .052 |
| HP1 = 6292 pounds per square inch (above the fan in the apparatus) |
| Example: The hydrostatic pressure at 11000 square feet with 10 pound mud |
| HP2 = 11000 × 10 × .052 |
| HP2 = 5720 pounds per square inch (below the fan in the apparatus) |
| Amount of HP difference, PSI = Delta HP (change in HP), |
| Delta HP = HP1 − HP2 |
| Delta HP = 6292 − 5720 PSI |
| Delta HP = 572 PSI (Wherein the total weight created by the string is equal to the Delta HP × the area). |
| Area of a 10 inch hole: |
| A = ¶ r2 |
| A = 3.14 × (5)2 |
| A = 3.14 × 25 |
| A = 78.5 square inches |

-continued

| The formula for measuring Hydro-Static pressure (PSI): |
|---|
| Total Weight (TW) created for dill weight: |
| TW = Delta HP × A (area in square inches) |
| TW = 572 × 78.5 |
| TW = 44,902 pounds. |

Therefore, if the fan in the apparatus is able to pull an equivalent of 1 pound of mud weight away from the drill bit by use of the apparatus, one has effectively decreased the weight of the mud column on the drill bit by 44,902 pounds. That is 44,902 pounds less pressure on the formation which would more readily allow the formation to be cut into and broken away during the drilling of the well. As the weight, therefore, on the bit is created without the use of drill collars as is done in the present state of the art.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for reducing the hydro-static pressure at the drill bit, comprising:

a. an elongated member connectably situated in a drill string between a rotating mud motor and a drill bit;

b. a second tubular member positioned concentrically within the first member and rotating in conjunction with the rotation of the mud motor;

c. gearing means situated between the first and second members;

d. means on the second member for imparting rotation to the gear means; and e. fan means incorporated within the first member and rotating in unison with the rotation of the gear means to draw drilling mud away from the drill bit for reducing the hydro-static pressure at the bit.

2. The apparatus in claim 1, wherein the first member further includes a substantially vertical housing on the upper portion and a flared housing on its lower portion for accommodating the fan means.

3. The apparatus in claim 1, wherein the gearing means further includes a pair of upper gear members attached to a pair of lower gear members for imparting rotation to the lower gear members.

4. An apparatus situated intermediate a mud motor and a drill bit in a rotating drill string, for reducing the hydrostatic mud pressure in the bit, the apparatus comprising:

a. a substantially vertical outer housing attachable on its upper end to the mud motor and at its lower end to the drill bit;

b. an internal shaft member including a flow bore therethrough rotatable within the housing and further allowing mud to be directed through the flow bore from the mud motor into the drill bit;

c. gear members contained within the housing in gearing relation to the internal shaft member so that rotation of the internal shaft member imparts rotation to the gear members;

d. a fan member in gearing relationship to the gear members, further including a fan body having in its lower end a plurality of fan blades which are rotated in unison with the rotation of the gearing members; and e. port means contained within the wall of the housing for allowing drilling mud drawn away from the drill bit by the rotation of the fan members to flow to an area outside of the outer housing.

5. The apparatus in claim 4, wherein the gear members further includes a first gear on the outer wall of the internal shaft member for gearing up to a second pair of gears within the housing.

6. The apparatus in claim 4, wherein the rotation of the fan member lifts the mud away from the bit for reducing the weight of the mud around the bit.

7. The apparatus in claim 4, wherein there is further sealing means mounted on the exterior surface of the outer housing for forcing the mud pulled away from the bit to travel through the rotating fan member.

8. An apparatus situated in a drill string between a rotating mud motor and a drill bit, comprising:

a. an elongated housing;

b. a shaft member coaxially aligned within a portion of the housing, the shaft member rotatable in unison with the rotation of the mud motor;

c. fan means within the housing for drawing mud away from the drill bit as the fan means is rotated; and d. gear means intermediate the shaft member and the fan means for imparting rotation to the fan means as the shaft member is rotated e. port means within the wall of the housing for receiving mud drawn away from the drill bit by the rotation of the fan means for allowing mud drawn away from the drill bit by rotation of the fan means to an area exterior to the housing.

9. The apparatus in claim 8, wherein the gear means further includes a bell gear located between the shaft member and the fan means.

10. The apparatus in claim 8, wherein there may be further included additional gear members for imparting greater rotational speed to the fan means as the shaft member is rotated.

* * * * *